United States Patent [19]

Mouraret

[11] 4,281,996

[45] Aug. 4, 1981

[54] PROPELLER WITH A WATER-JET FOR CRAFTS

[76] Inventor: Michel Mouraret, 16, rue des Amouriers, Celleneuve, Montpellier (Herault), France

[21] Appl. No.: 7,716

[22] Filed: Jan. 30, 1979

[30] Foreign Application Priority Data

Feb. 1, 1978 [FR] France ..... 78 02794

[51] Int. Cl.[3] ..... B63H 23/32; B63H 11/10

[52] U.S. Cl. ..... 440/89; 440/40

[58] Field of Search ..... 60/221; 440/89, 38, 440/40

[56] References Cited

U.S. PATENT DOCUMENTS

| | | | |
|---|---|---|---|
| 3,044,260 | 7/1962 | Hamilton | 115/16 X |
| 3,625,176 | 12/1971 | Moellering | 115/12 R |

FOREIGN PATENT DOCUMENTS

| | | | |
|---|---|---|---|
| 1071054 | 6/1967 | United Kingdom | 115/12 A |

*Primary Examiner*—Sherman D. Basinger

*Attorney, Agent, or Firm*—Charles E. Baxley

[57] ABSTRACT

The invention provides a propeller with a water-jet for crafts consisting of an outboard motor capable of being swivelled at any angle and carrying structure for fixing it at the rear of a craft, a propeller wherein there is a propulsion unit rigidly secured to said outboard motor, the rotor and water-inlet and water-outlet of which are positioned along one and the same axis and perpendicular to the output axis of the outboard motor, the water-inlet and water-outlet of the propulsion unit carrying water-inlet and outlet nozzles whose slewing makes angles substantially identical to one another in relation to the axis of the propulsion unit while being swivelled, one of them above the axis, the other beneath it.

1 Claim, 4 Drawing Figures

PROPELLER WITH A WATER-JET FOR CRAFTS

The invention relates to a propeller with a water-jet for crafts.

Propulsion units known as "axial-flow propulsion units" are already known, whose rotor, the water-inlet and water-outlet are positioned along one and the same axis. These propulsion units are associated with outboard motors which are fixed free to swivel inside the transom of a craft.

However, such devices have a low output essentially in view of the power-losses due to the positioning and slewing of the propulsion unit and of its water-inlet and outlet in relation to the direction of the relative displacement of the water in relation to the moving craft.

Thus, the speeds obtained with such crafts are very low.

The present invention is particularly aimed at remedying these drawbacks and to this end provides a propeller with a water-jet for crafts carrying an outboard motor capable to be swivelled at any angle and carrying means for securing it to the transom of a craft, a propeller wherein there is a propulsion unit rigidly fixed to said outboard motor, whose rotor and water-inlet and outlet are positioned along one and the same axis and perpendicular to the outlet axis of the outboard motor, the water-inlet and outlet of the propulsion units carrying water-inlet and outlet nozzles the slewing of which makes angles substantially identical to one another in relation to the axis of the propulsion unit while being respectively swivelled above and beneath the axis.

According to a further characteristic feature of the invention, the nozzles have substantially an equal length.

According to another feature of the invention, each nozzle has a double bend.

The invention is presented by way of non-limitative example in the attached drawings, wherein.

Figure 1:
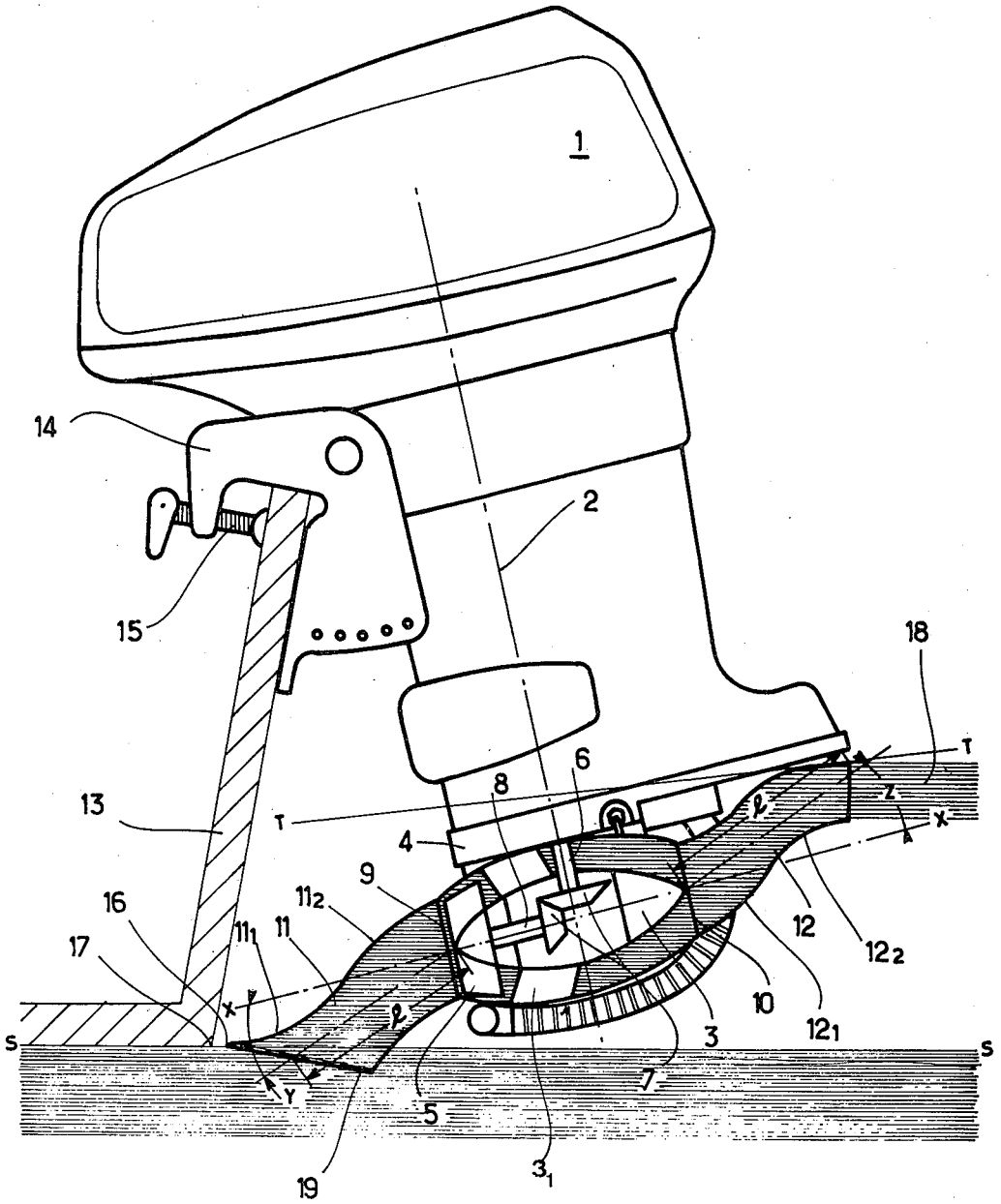
FIG. 1 is a schematic front elevation in part section of a propeller according to the invention.
Figure 4:
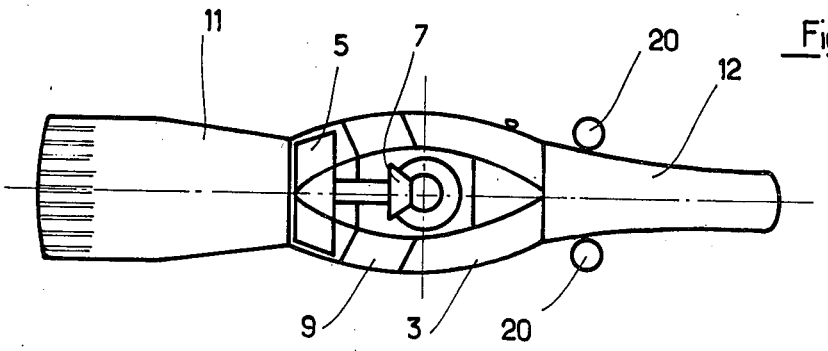
FIG. 4 is a view along A—A of FIG. 2. Consequently, the present invention is aimed at achieving a propeller with a water-jet which while secured to the transom of a craft can communicate a great running speed to the craft.

Also, the present invention is aimed at achieving a propeller with a water-jet which keeps a good stability for the craft, even when rapid turns with a small radius are performed.

As it can be seen in the attached drawings, the propeller with a water-jet consists of an outboard motor 1 whose output shaft or axis 2 is connected to a propulsion unit 3 directly fixed to the stage 4 of the basis of said outboard motor.

The rotor 5 of the propulsion unit 3 is driven from the axis 2 of the outboard motor through the shaft 6 which extends coincident with the axis 2 to the bevel gears 7 and to the shaft 8 that is fitted to revolve inside the stator of the propulsion unit 3.

Nozzles 11 and 12 are respectively provided on the water-inlet 9 and the water-outlet 10 of the propulsion unit, the nozzles being designed to pipe the water without generating excessive power-losses.

The outboard motor is mounted free to swivel, as already known, and is removably fixed outside the stern transom of a craft 13 by means of a device 14 carrying tightening screws 15.

As shown in the attached FIG. 1, the propulsion unit 3 is an axial-flow propulsion unit and the water-inlet 9, the rotor 5 and the water-outlet 10 are positioned along one and the same axis X—X constituting the axis of said propulsion unit.

Furthermore, the propulsion unit is secured to the outboard motor 1 so that said axis X—X is perpendicular to the axis 2 of the outboard motor, while the water-inlet and outlet nozzles 11 and 12 connected to inlet and outlet 9 and 10 are swivelled in relation to the axis X—X of the propulsion unit in such a way as they make with said axis angles Y and Z substantially identical to one another but directed, one of them (Y) towards the basis of the propulsion unit and the other (Z) towards the upper part of the propulsion unit.

Such a positioning then makes it possible to reduce the power-losses to a minimum and thereby to increase the speed of the craft without modifying the stability thereof while moving in a straight or in a curved course.

In particular, it will be noted that the axis 2 of the outboard motor is slightly inclined on the vertical, so that when the motor pivots to execute turns, it makes the height of the extreme front edge 16 of the inlet nozzle 11 vary in relation to the rear lower edge 17 of the transom of the craft 13, said rear edge 17 of the craft being located along the line S—S corresponding to the surface of the water.

Thus, when executing short radius turns, it can be seen that said edge 16 rises in relation to the edge 17 so as to reduce the power without modifying the stability of the craft.

The lengths 1 of the inlet nozzle 11 and outlet nozzle 12 are substantially identical to one another so as to balance the loads, while each of these nozzles have a double bend with progressive evolution $\mathbf{11}_1$, $\mathbf{11}_2$, $\mathbf{12}_1$ and $\mathbf{12}_2$, so that the extreme bends $\mathbf{11}_1$ and $\mathbf{12}_2$ end in directions parallel to the line S—S of the surface of the water.

The water-jet 18 delivered by the nozzles 12 is then parallel and above the water level, said water level being shown by the line T—T when the craft is stopped.

Also, in such a construction the inlet of the nozzle 11, whose extreme point 16 is located at a level with and near by the lower edge 17 of the craft, carries a grid 19 preventing solid bodies from penetrating inside the propulsion unit 3.

According to the invention, the exhaust-pipe of the outboard motor 1 is divided into two legs 20 and 21, one end of which is connected to the stage 4, and the other to a connecting piece 22 carrying the outlet 23 of the exhaust-pipe.

Figure 3:
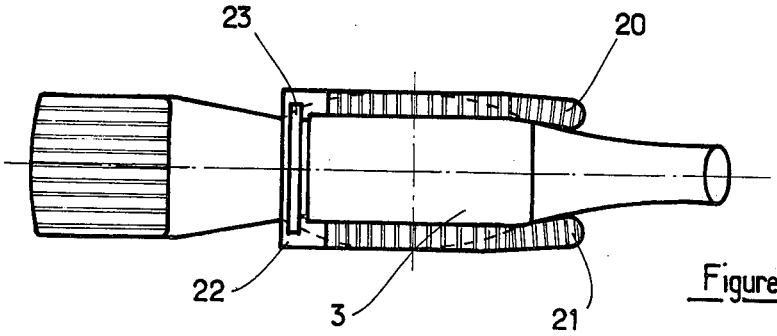
FIG. 3 is a bottom elevation of FIG. 2.
Figure 2:
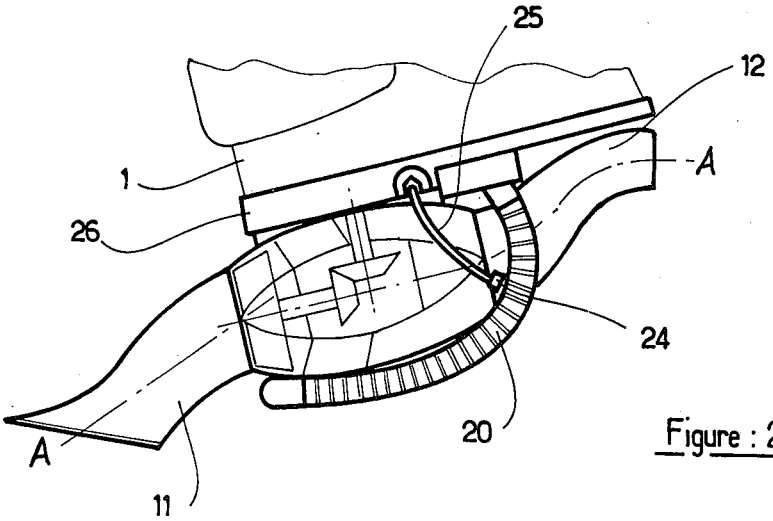
FIG. 2 is a schematic side view of the propulsion unit.

Both legs 20 and 21 are positioned laterally and beneath the propulsion unit 3 (see FIGS. 2 and 3) so as to reduce the resistance generated by the pipe, the connecting element 22 being positioned beneath the propulsion unit 3, directly behind the inlet nozzle 11, so as to fully protect the outlet 23.

So as to ensure the cooling of the outboard motor 1, a propulsion unit 3 is provided and, at the water-outlet a water intake 24 is connected by a piping 25 to the basis 26 which itself carries channels pertaining to the cooling circuit of the motor.

Thus, said part 26 serving as a support to the propulsion unit 3 also carries the channels extending outside by the two legs 20 and 21 of the exhaust-pipe and the tube 25 serving to drain off the water under pressure taken at the outlet of the propulsion unit.

What I claim is:

1. A water-jet propeller for a boat provided with an outboard having an output axis, the engine being capable of being swivelled, carrying means for securing the outboard engine to the stern of the boat, a propeller rigidly secured to the outboard engine, the propeller comprising a propulsion unit provided with an inlet aperture for water and an outlet aperture for water, a rotor for said propulsion unit, said rotor and apertures being arranged in axial alignment and perpendicular to the output axis of the outboard engine, inlet and outlet nozzles attached respectively to said inlet and outlet apertures, said nozzles making angles respectively that are substantially identical to one another in relation to said rotor axis of said propulsion unit while said angles are directed one of them above said rotor axis, the other beneath the same, an exhaust-pipe for said outboard engine, said exhaust pipe being parted into two legs each laterally positioned beneath the propulsion unit, said two legs joined together to form an exhausting aperture arranged beneath said propulsion unit and behind the inlet nozzle for the water.

* * * * *

UNITED STATES PATENT AND TRADEMARK OFFICE

CERTIFICATE OF CORRECTION

PATENT NO. : 4,281,996
DATED : August 4, 1981
INVENTOR(S) : Michel Mouraret

It is certified that error appears in the above-identified patent and that said Letters Patent are hereby corrected as shown below:

Column 3, line 5, (Claim 1) after "outboard" the word --engine-- should be inserted.

Signed and Sealed this
*Eighteenth* Day of *May 1982*

[SEAL]

*Attest:*

GERALD J. MOSSINGHOFF

*Attesting Officer*

*Commissioner of Patents and Trademarks*